US010224654B1

(12) United States Patent
Su et al.

(10) Patent No.: US 10,224,654 B1
(45) Date of Patent: Mar. 5, 2019

(54) CONNECTION DEVICE WITH FLOATABLE SELF-ADJUSTING CONTACTS AND CONNECTING METHOD THEREOF

(71) Applicant: NEXTRONICS ENGINEERING CORP., New Taipei (TW)

(72) Inventors: Hou-An Su, Keelung (TW); Hai-Wen Yang, Baoji (CN); Yong Zhang, Guangzhou (CN)

(73) Assignee: NEXTRONICS ENGINEERING CORP., New Taipei (TW)

( * ) Notice: Subject to any disclaimer, the term of this patent is extended or adjusted under 35 U.S.C. 154(b) by 0 days.

(21) Appl. No.: 15/854,595

(22) Filed: Dec. 26, 2017

(30) Foreign Application Priority Data

Aug. 28, 2017 (CN) ..... 2017 1 0751495

(51) Int. Cl.

| | |
|---|---|
| ***H01R 12/77*** | (2011.01) |
| ***H01R 12/78*** | (2011.01) |
| ***H01R 13/08*** | (2006.01) |
| ***H01R 43/26*** | (2006.01) |
| ***H01R 13/193*** | (2006.01) |
| ***H01R 13/502*** | (2006.01) |

(Continued)

(52) U.S. Cl.
CPC ..... *H01R 12/777* (2013.01); *H01R 12/774* (2013.01); *H01R 12/78* (2013.01); *H01R 13/08* (2013.01); *H01R 13/193* (2013.01); *H01R 13/502* (2013.01); *H01R 13/516* (2013.01); *H01R 13/642* (2013.01); *H01R 43/26* (2013.01)

(58) Field of Classification Search
CPC ..... H01R 13/6315; H01R 13/187; H01R 13/193; H01R 12/57; H01R 13/08; H01R 13/642; H01R 13/502; H01R 13/516; H01R 12/777; H01R 12/774; H01R 12/78; H01R 43/26
USPC ..... 439/246, 260, 252
See application file for complete search history.

(56) References Cited

U.S. PATENT DOCUMENTS 4,881,901 A * 11/1989 Mendenhall ..... H01R 12/79 439/260
8,366,453 B2 * 2/2013 Chang ..... H01R 12/58 439/66

(Continued)

FOREIGN PATENT DOCUMENTS

TW 515221 U 1/2016

*Primary Examiner* — Gary F Paumen
(74) *Attorney, Agent, or Firm* — Li & Cai Intellectual Property (USA) Office

(57) ABSTRACT

A connection device with floatable self-adjusting contacts includes a first main body, a plurality of first and second contact point groups, a second main body, and a plurality of conducting boards (pin boards). The first and second contact groups are respectively disposed on the first and second bodies. The floating board is disposed on the second main body in a floating manner. The conducting board has an insulated main body and a plurality of conducting pins which are disposed on the insulated main body in a floating manner. The conducting pin has a first conducting portion contacting the first contact point, and a second conduct portion contacting the second contact point. The first and second conduct portions respectively have an arc-shaped periphery and an elastic arm. The conducting pins can respectively self-adjust to achieve an optimal downward contacting pressure.

11 Claims, 12 Drawing Sheets

(51) Int. Cl.
*H01R 13/516* (2006.01)
*H01R 13/642* (2006.01)

(56) References Cited

U.S. PATENT DOCUMENTS

| | | | | |
|---|---|---|---|---|
| 9,496,638 | B1 * | 11/2016 | Su | H01R 4/363 |
| 2005/0186820 | A1 * | 8/2005 | Maeda | H01R 13/193<br>439/260 |

* cited by examiner

CONNECTION DEVICE WITH FLOATABLE SELF-ADJUSTING CONTACTS AND CONNECTING METHOD THEREOF

BACKGROUND OF THE INVENTION

1. Field of the Invention

The present disclosure relates to a connection device and method with floatable self-adjusting contacts; more particularly, to a connection device and method with high density contact point.

2. Description of Related Art

Connectors, i.e., connection devices that electrically connect cables, printed circuit boards and other circuit devices, have been widely used in electronic devices found in our daily lives. A conventional connector implements a connection through a mechanism of two surfaces, with the contact points being distributed on the x- and y-axes, making it difficult to increase the density of the contact points.

Connectors can be applied in many domains, one such domain being medical instruments. Some medical instruments require continuous improvement in technology and the integration of new functions, so that the required points for transmission on a connector are also required to be increased. The number of contact points in a single connector is limited, thus, multiple connectors need be employed in order to achieve electronic connection. However, the more connectors that are applied, the more space will be taken up, causing inconvenience for operation of medical instruments.

Therefore, there is dire need in the industry for an improved connection device with floatable self-adjusting contacts (i.e., contact points) and connecting method thereof.

SUMMARY OF THE INVENTION

A connection device with floatable self-adjusting contacts and connecting method thereof suitable for the current limited space are provided in the present disclosure to solve the technical issues presented above. The connection manner of the present disclosure is by 3D mechanical connection, which effectively increases the density of contact points, and generates forces perpendicular to the contact points. Furthermore, by the design of the floatable conducting pin, the conducting pin exhibits a better elastic performance, and a contact force is guaranteed, so that an optimal electrical contact effect can be achieved.

The connection device with floatable self-adjusting contacts of the present disclosure includes a first main body, a second main body, and a plurality of conducting boards floatably disposed on the second main body. Each of the plurality of conducting boards has an insulated main body, and a plurality of conducting pins being disposed on the insulated main body in a floating manner. Each of the plurality of conducting pins has a first contact portion and a second contact portion, the first and second contact portions being formed at two ends of the conducting pin, the outer edge of the first contact portion being an arced surface, the outer edge of the second contact portion being an arced surface, and the first and second contact portions respectively being exposed from the two surfaces of the insulated main body. A plurality of first contact point groups are disposed on the first main body and are tilted, and a plurality of second contact point groups are disposed on the second main body are tilted. The plurality of first contact point groups have a plurality of first contact points exposed from the outer edge of the first contact point groups, and the plurality of second contact point groups have a plurality of second contact points exposed from the inner edge of the second contact point groups. The second contact portions of the conducting pins are correspondingly in contact with the second contact points, and when the first main body and the second main body are engaged with one another, the first contact portions of the conducting pins are correspondingly in contact with the first contact points. By conducting the first contact points and the second contact points through the conducting pins, the plurality of first contact point groups electrically connect with the plurality of second contact point groups.

The connection method with floatable self-adjusting contacts of the present disclosure includes providing a connection device with floatable self-adjusting contacts including a first main body, a second main body, a plurality of conducting boards, a plurality of first contact point groups and a plurality of second contact point groups. The plurality of conducting boards are floatably disposed on the second main body, each of the plurality of conducting boards has an insulated main body, and a plurality of conducting pins are disposed on the insulated main body in a floating manner. Each of the plurality of conducting pins has a first contact portion and a second contact portion, the first and second contact portions being formed at two ends of the conducting pin, the outer edge of the first contact portion being an arced surface, the outer edge of the second contact portion being an arced surface, and the first and second contact portions respectively being exposed from the two surfaces of the insulated main body. The plurality of first contact point groups are disposed on the first main body and are tilted, and the plurality of second contact point groups are disposed on the second main body are tilted. The plurality of first contact point groups have a plurality of first contact points exposed from the outer edge of the first contact point groups, and the plurality of second contact point groups have a plurality of second contact points exposed from the inner edge of the second contact point groups. The second contact portions of the conducting pins are correspondingly in contact with the second contact points, and when the first main body and the second main body are engaged with one another, the first contact portions of the conducting pins are correspondingly in contact with the first contact points. By conducting the first contact points and the second contact points through the conducting pins, the plurality of first contact point groups being electrically connect with the plurality of second contact point groups.

The effects of the present disclosure are as follows. The connection manner of the connection device with floatable self-adjusting contacts according to the present disclosure is by 3D mechanical connection. The inclination surfaces of the present disclosure can generate more contact points than straight surfaces, thereby increasing the density of the contact points. The conducting board is disposed on the second main body in a floating manner and the conducting pin is also disposed on the insulated main body in a floating manner, so that the conducting pin has a floatable design. The conducting pins in the conducting board can respectively, through self-adjustment, reach an optimal downward pressure for each contact point, so as to achieve an optimal electrical contact. The present disclosure, by the floating state of the conducting pin, achieves an optimal manner of connection, thereby overcoming the process dimension tolerance and the problems of uneven contact height due to the deformation of the contact surface of the main body.

The surface of the first contact portion and the second contact portion of the conducting pins is an arced surface close to the first contact point and the second contact point, which exerts a greater normal force to the first contact point and the second contact point. The first contact and second contact portions of the conducting pin provide a contact normal force perpendicular to the first and second contact points to achieve to an optimal electrical contact effect.

Moreover, the second contact portion of the conducting pin is an elastic arm, which is capable of exerting a greater normal force to the second contact point, thereby achieving an optimal electrical contact effect.

In order to further the understanding of the present disclosure, the following embodiments are provided along with illustrations to facilitate the disclosure of the present disclosure.

DETAILED DESCRIPTION OF THE PREFERRED EMBODIMENTS

Figure 1:
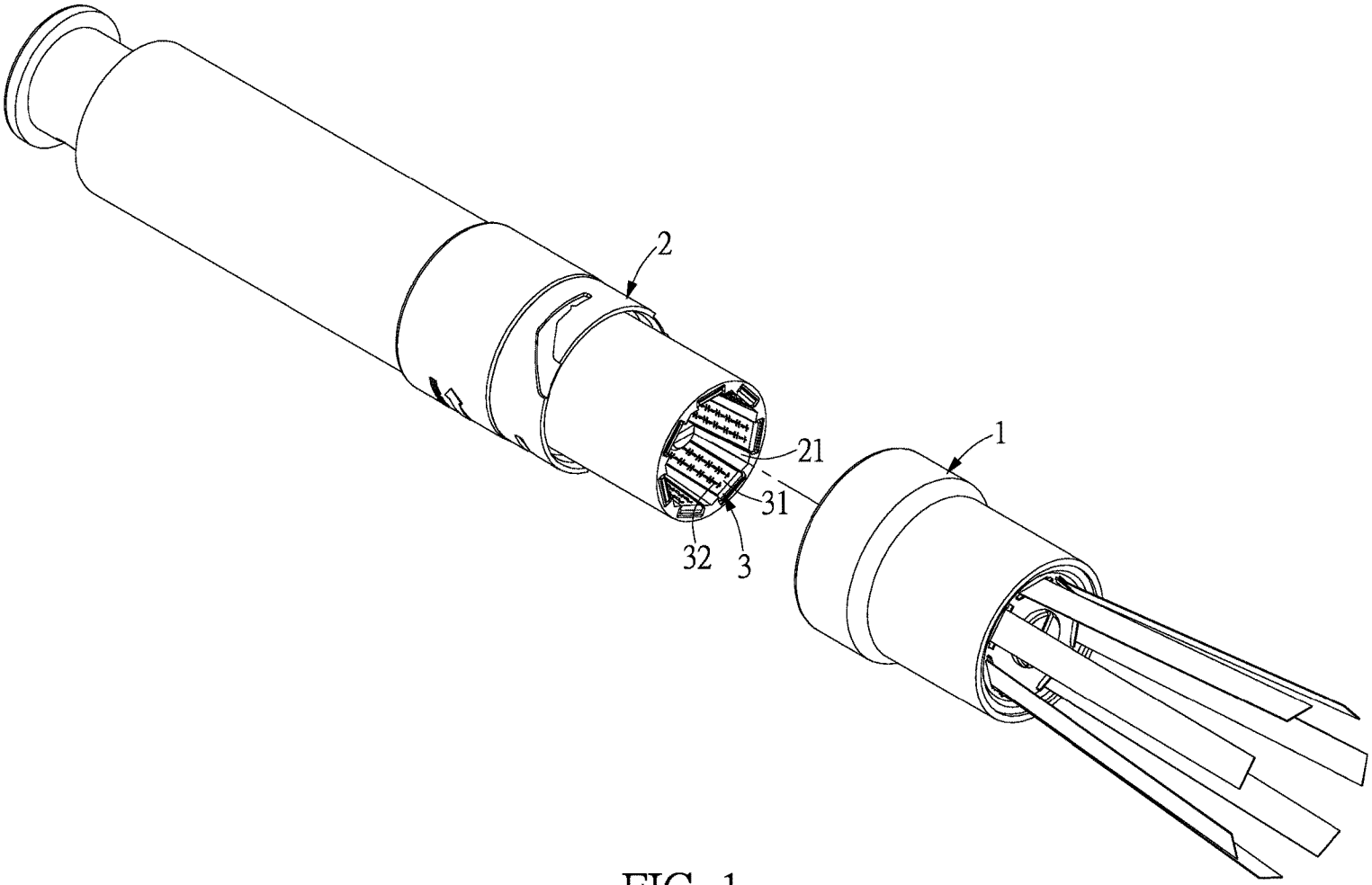
FIG. 1 is a 3D decomposition view of a connection device according to the present disclosure.
Figure 2:
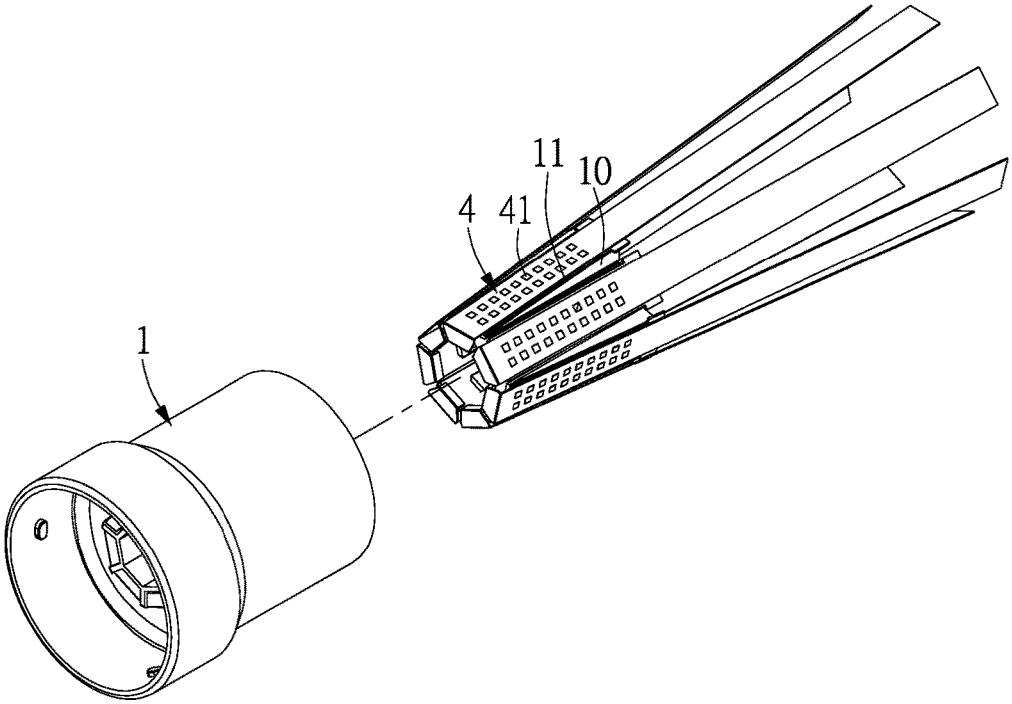
FIG. 2 is a 3D view of the female end of the connection device according to the present disclosure.
Figure 3:
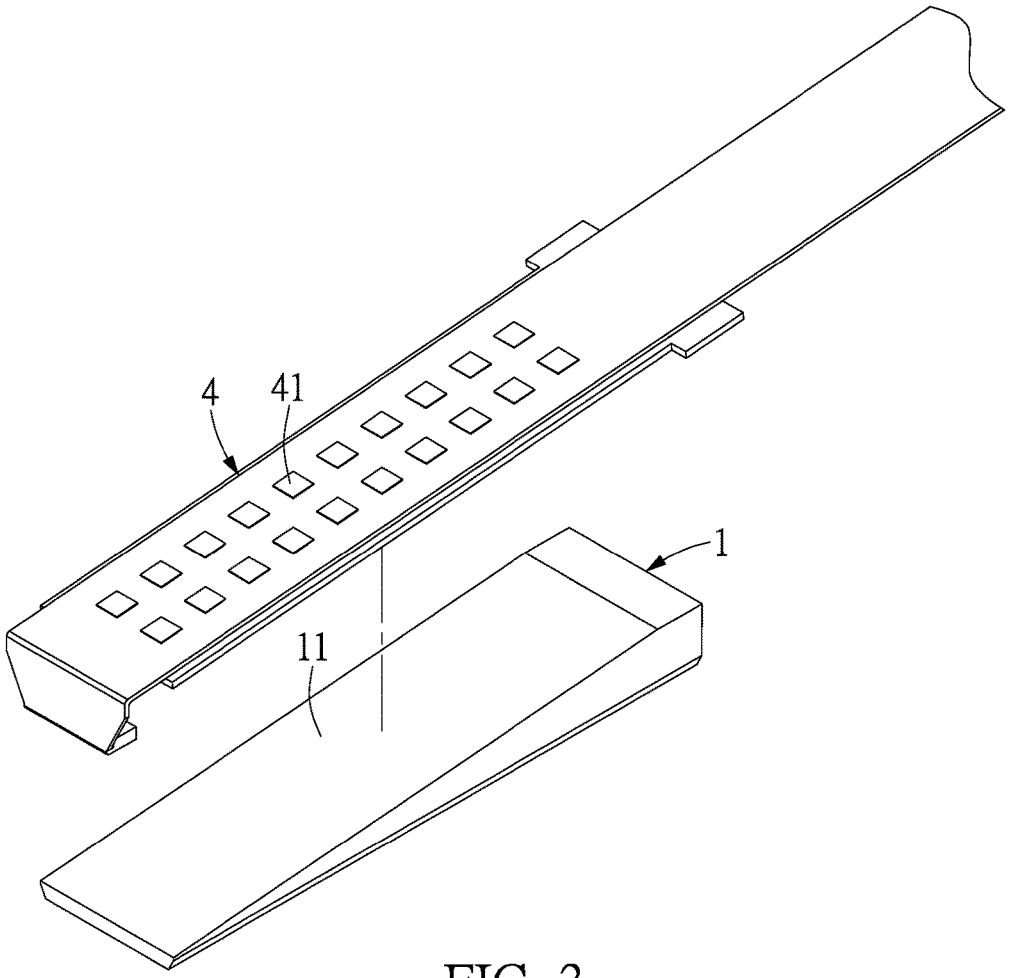
FIG. 3 a 3D decomposition view of the first contact point group and the first main body according to the present disclosure.
Figure 4:
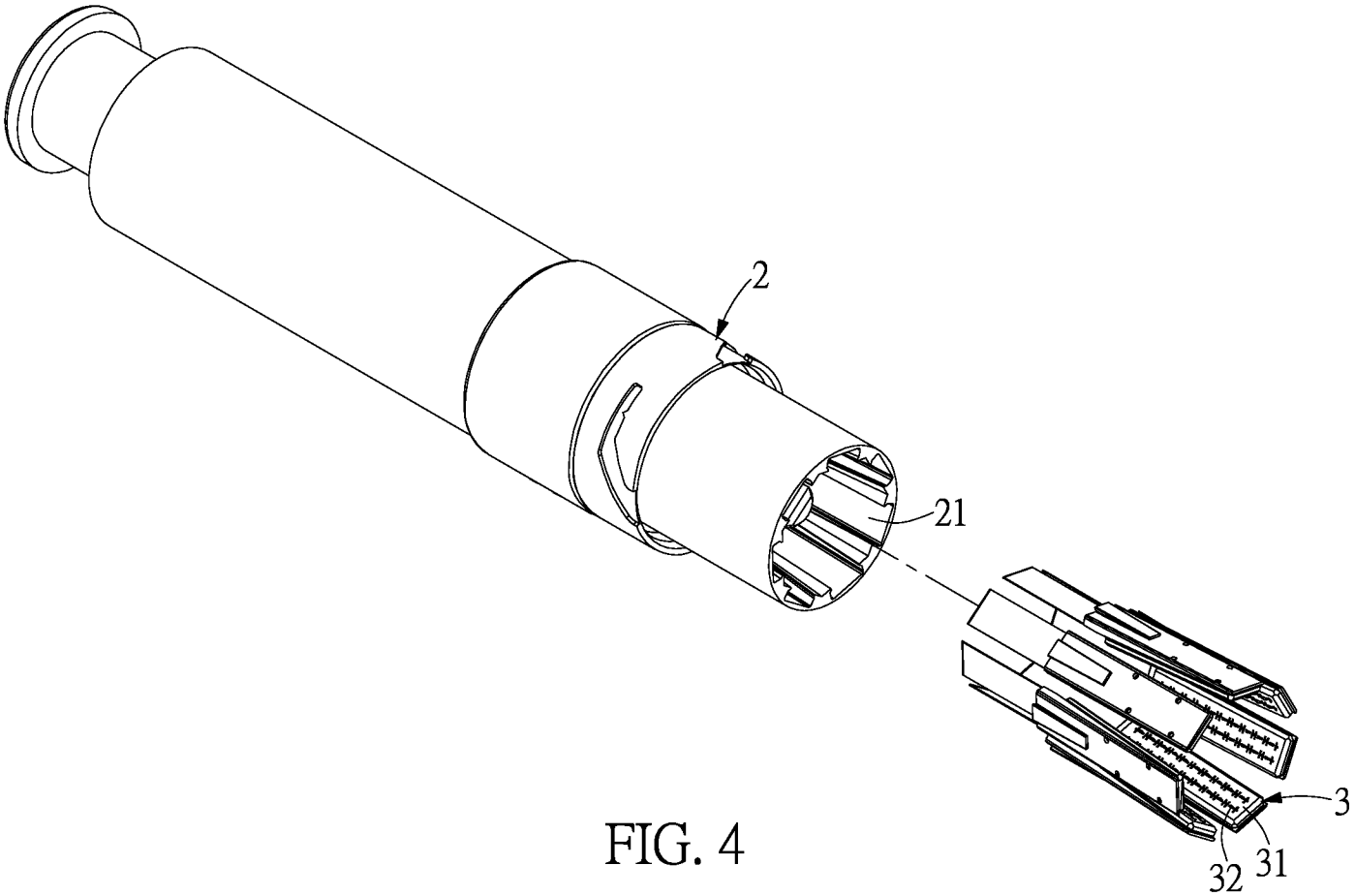
FIG. 4 is a 3D view of the male end of the connection device according to the present disclosure.
Figure 5:
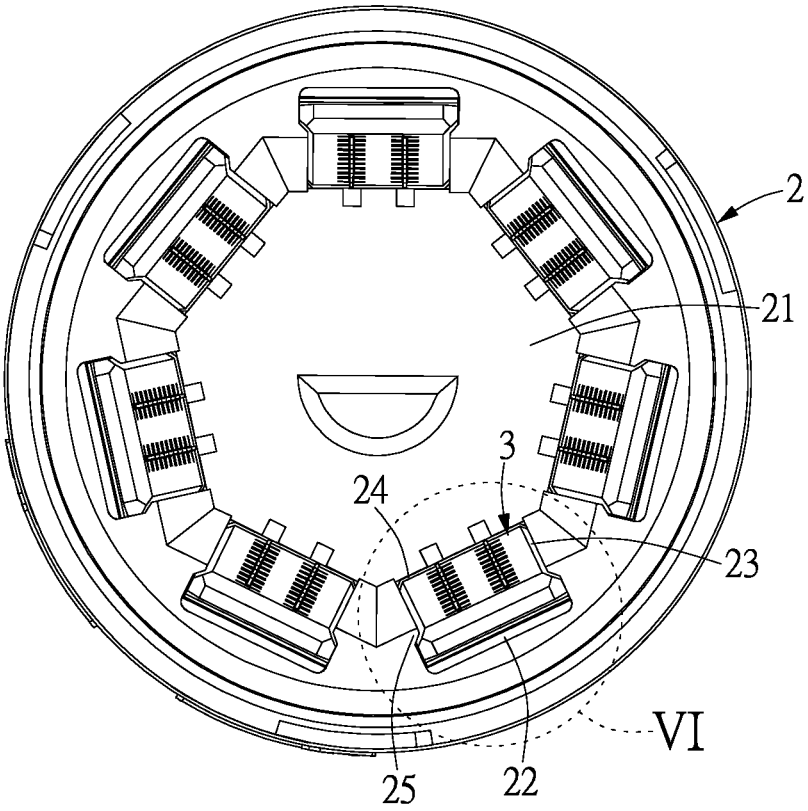
FIG. 5 is a side view of the male end of the connection device according to the present disclosure.
Figure 6:
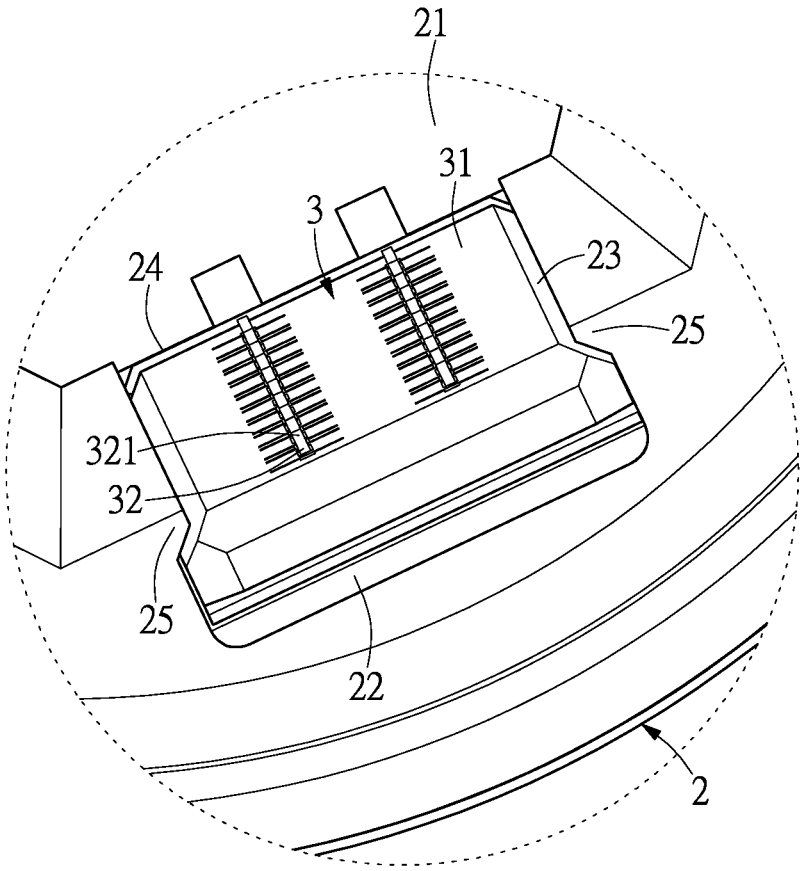
FIG. 6 is a partial view of portion IV of FIG. 5.
Figure 7:
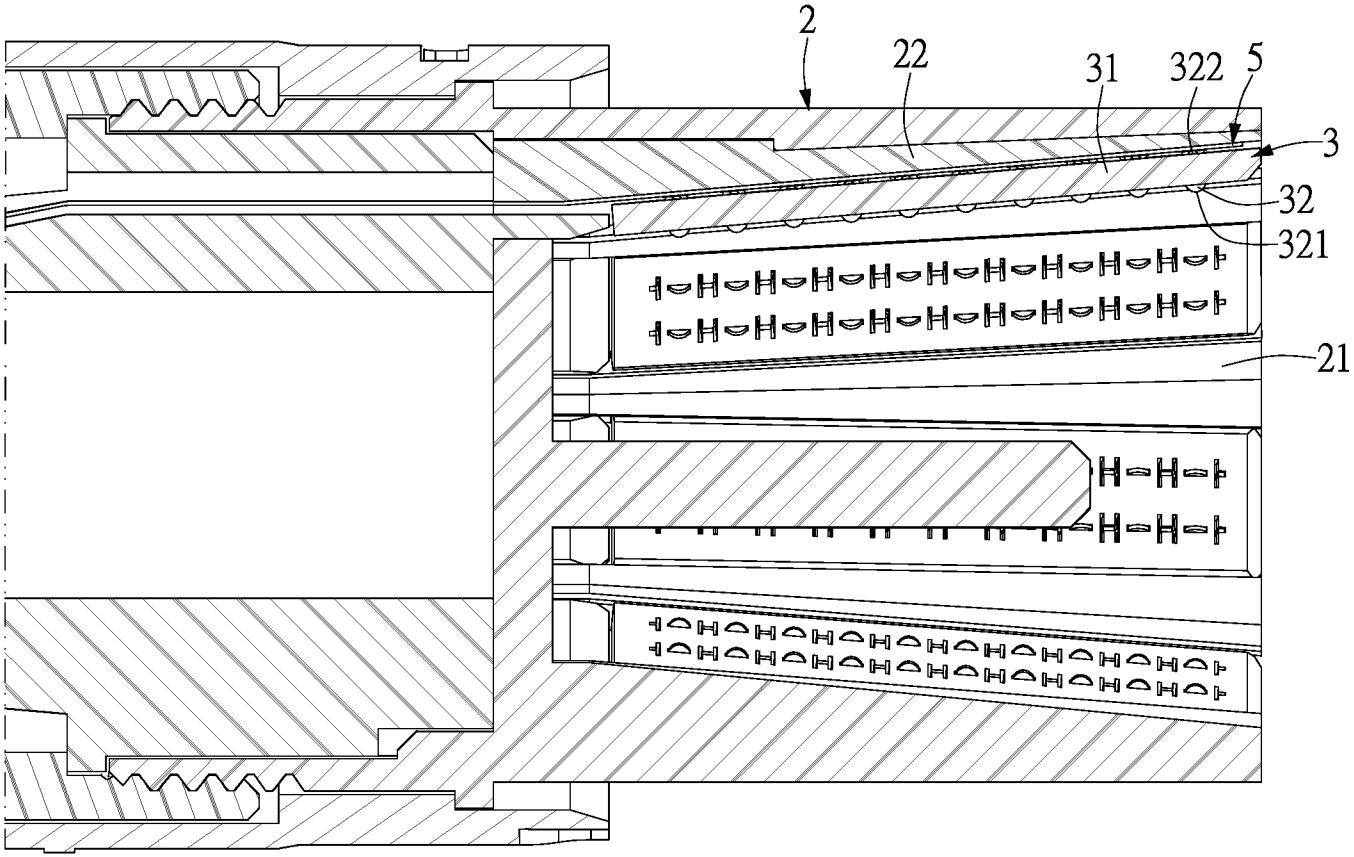
FIG. 7 is a sectional view of the male end of the connection device according to the present disclosure.
Figure 8:
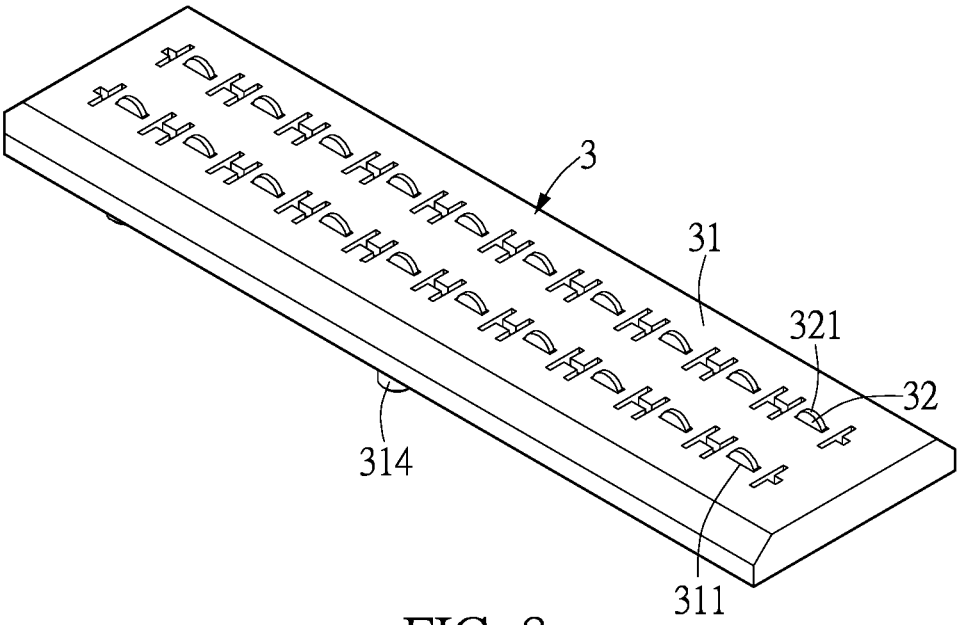
FIG. 8 is a 3D view of a conducting board according to the present disclosure.
Figure 9:
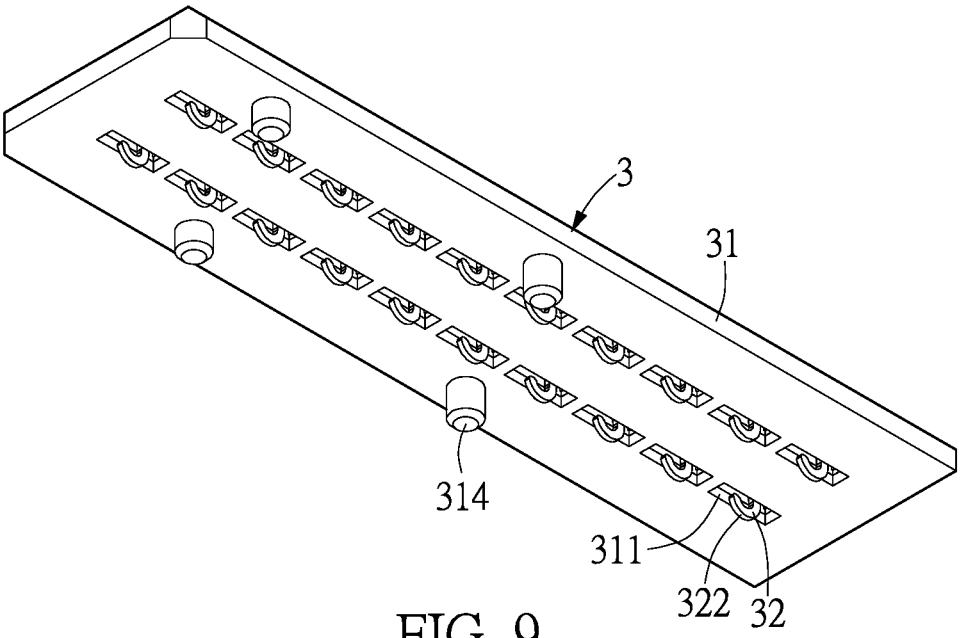
FIG. 9 is a 3D view viewed from another angle of a conducting board according to the present disclosure.
Figure 10:
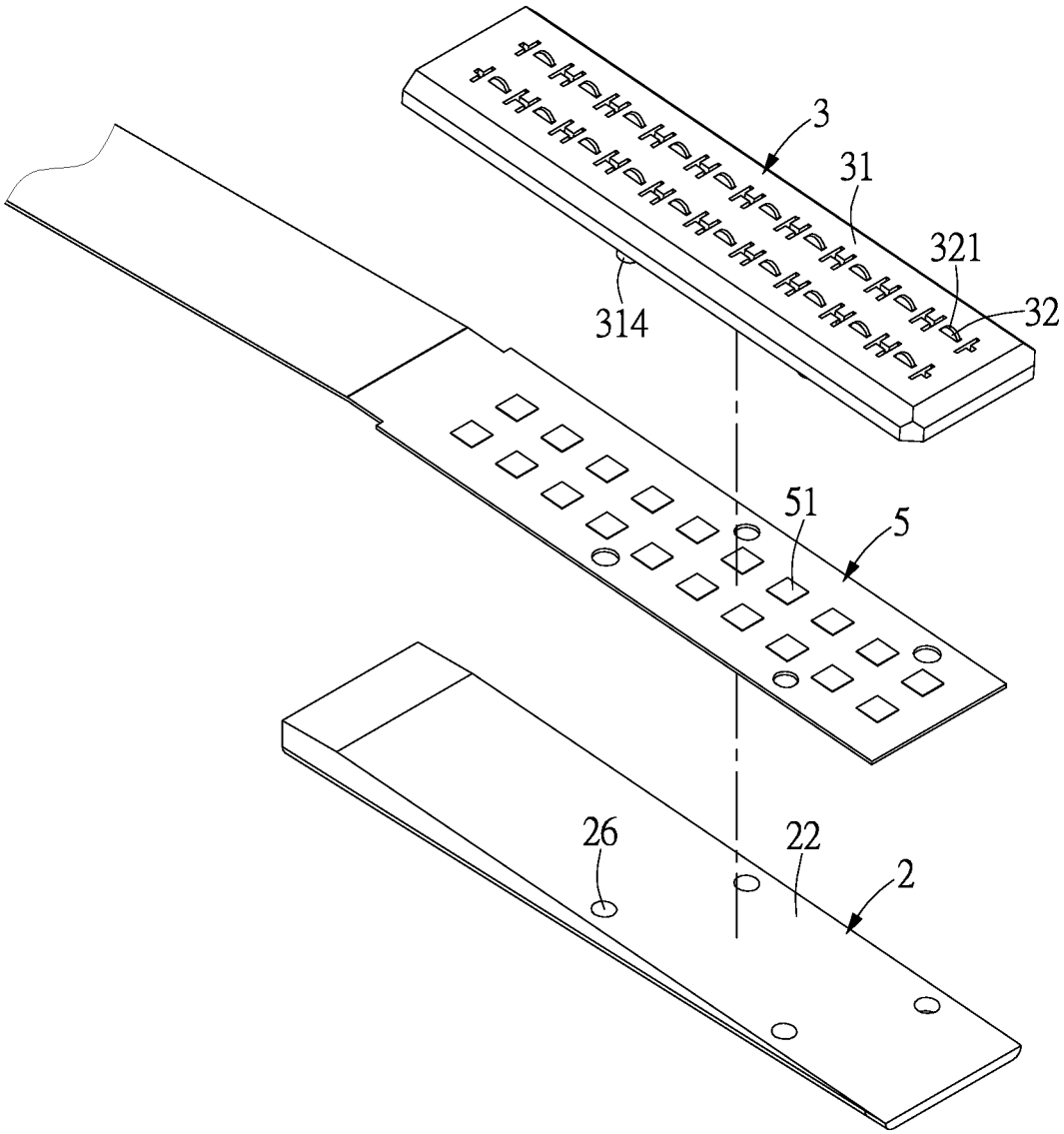
FIG. 10 is a 3D decomposition view of the conducting board, the second contact point group and the second main body according to the present disclosure.
Figure 11:
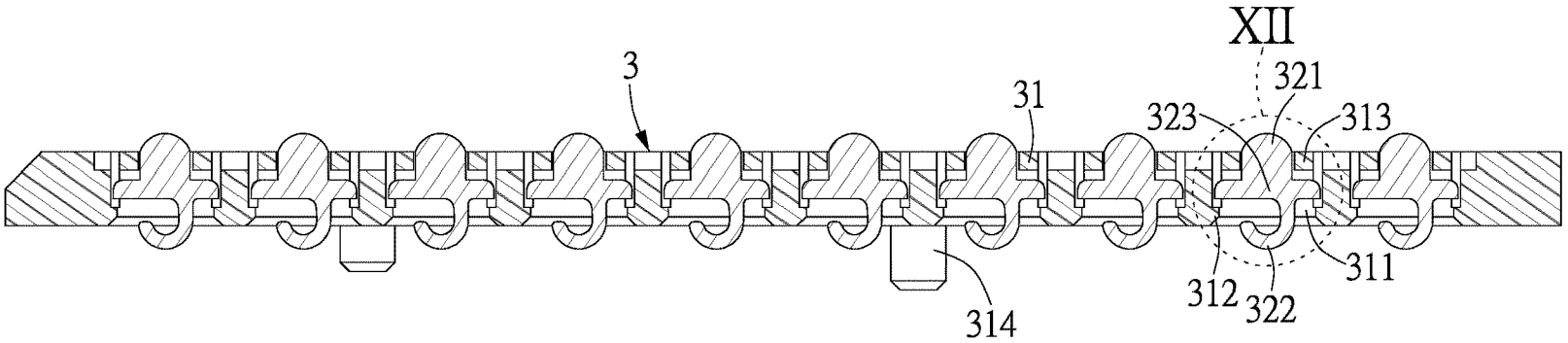
FIG. 11 is a sectional view of the conducting board according to the present disclosure.
Figure 12:
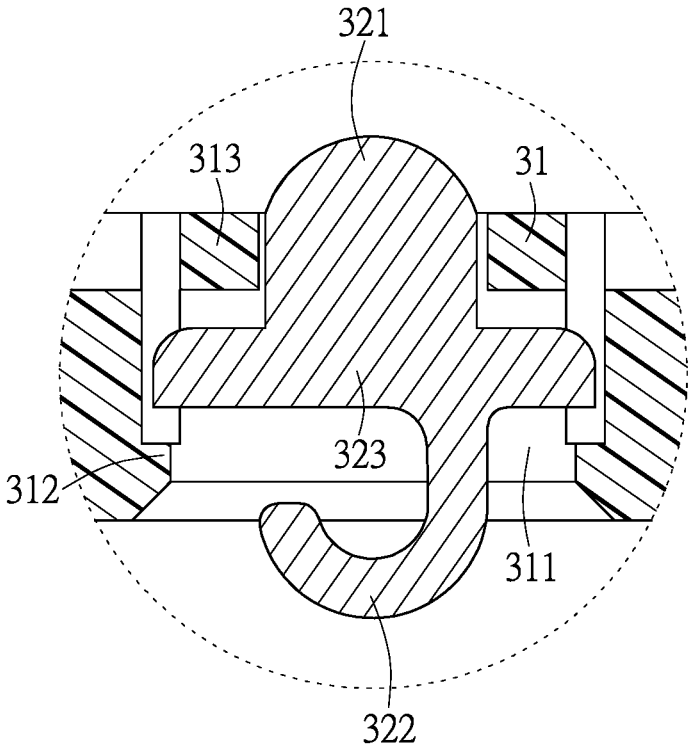
FIG. 12 is a schematic view showing the details of portion XII of FIG. 11.

The aforementioned illustrations and following detailed description are exemplary for the purpose of further explaining the scope of the present disclosure. Other objectives and advantages related to the present disclosure will be illustrated in the following description and appended drawings.

The First Embodiment

Reference is made to FIGS. 1-12, the connection device with floatable self-adjusting contacts of the present disclosure includes a first main body 1, a second main body 2, a plurality of conducting boards (pin boards) 3, a plurality of first contact point groups 4 and a plurality of second contact point groups 5.

The first main body 1 can be made of plastic, or other insulating materials, however, the structure and the material of the first main body 1 are not limited thereto. In the present embodiment, the first main body 1 is in the form of a female end. The first contact point groups 4 are disposed on the first main body 1, and the first contact point groups 4 are tilted. In the present embodiment, the first main body 1 includes a cone body 10, in which the cone body can be such as a cone or a pyramid. The first main body 1 is disposed with a plurality of first inclination surfaces 11 to form a pyramid, and the plurality of first inclination surfaces 11 are integrally or compositely formed on the first main body 1. The plurality of the first contact point groups 4 are disposed on the first inclination surfaces 11, so that the first contact point groups 4 are tiltedly disposed on the first main body 1. The sloping angle of the first inclination surface 11 and the first contact point groups 4 are not limited, and the slope of the first contact point groups 4 can be defined as $\theta 1$, in which $\theta 1$ is between 0° and 90°. The cone body 10 of the first main body 1 is a pyramid so as to provide a better positioning effect.

The first contact point groups 4 can be a flexible printed circuit (FPC) board or a conducting wire and contact point after etching or electroplating. The structure of the first contact point group 4 is not limited; however, in the present embodiment, the first contact point groups 4 are a flexible printed circuit FPC board having a long plate shape, and are adhered on the first inclination surfaces 11.

The first contact point groups 4 can be fixed on the first inclination surface 11 by adhering, engaging or screws. The first contact point groups 4 include a conducting wire (not shown in the figure) and a contact point, i.e., the first contact point groups 4 include a plurality of first contact points 41. The plurality of first contact points 41 are made of metal with good conductivity or alloy, but the arrangement of the plurality of first contact points 41 is not limited and can be designed to meet different demands. The plurality of first contact points 41 are exposed from the outer edge of the first contact point groups 4 to electrically connect with the second contact point groups 5 through the conducting board 3. The first contact point groups 4 can further electrically connect with a wire or a printed circuit board.

The second main body 2 can be made of plastic, or other insulating materials; however, the structure and the material of the second main body 2 are not limited thereto. In the present embodiment, the first main body 1 is in the form of male end. The second contact point groups 5 are disposed on the second main body 2, and the second contact point groups 5 are tilted. In the present embodiment, an accommodation slot 21 is included in the second main body 2, and the accommodation slot 21 can be in a shape of taper hole, such as conical taper hole or a pyramidical taper hole. A plurality of second inclination surfaces 22 are formed in the accommodation slot 21 to form the pyramidical taper hole, and the plurality of second inclination surfaces 22 are integrally or compositely formed on the second main body 2. The plurality of the second contact point groups 5 are disposed on the second inclination surfaces 22, so that the second contact point groups 5 are tiltedly disposed on the second main body 2. The slopes of the second inclination surface 22 and the second contact point groups 5 are not limited, and the slope of the second contact point groups 5 can be defined as $\theta 2$, in which $\theta 2$ is between 0° and 90°. The accommodation slot 21 of the second main body 2 is a pyramidical taper hole so as to provide a better positioning effect.

The second contact point groups 5 can be a flexible printed circuit (FPC) board or a conducting wire and contact point after etching or electroplating. The structure of the second contact point group 5 is not limited; however, in the present embodiment, the second contact point groups 5 are a flexible printed circuit FPC board having a long plate shape, and are adhered on the second inclination surfaces 22.

The second contact point groups 5 can be fixed on the second inclination surface 22 by adhering, engaging or screws. The second contact point groups 5 include a conducting wire (not shown in the figure) and a contact point, i.e., the second contact point groups 5 include a plurality of second contact points 51. The plurality of second contact points 51 are made of metal with good conductivity or alloy, but the arrangement of the plurality of second contact points 51 is not limited, and can be designed to meet different demands. The plurality of second contact points 51 are exposed from the outer edge of the second contact point groups 5 to electrically connect with the first contact point groups 45 through the conducting board 3. The second contact point groups 5 can further electrically connect with a wire or a printed circuit board.

The conducting boards 3 are disposed on the second main body 2 in a floating manner, which means that a plurality of floating spaces 23 are compartmentally disposed on the second main body 2. The floating spaces 23 are circularly disposed on the second main body 2. A side of the floating space 23 closer to the accommodation space 21 is formed with an opening 24, which allows the first contact portion 321 of the conducting pins 32 to correspondingly contact with the first contact point 41 through the openings 24. The conducting boards 3 are disposed in the floating spaces 23 in a floating manner, the conducting board 3 is capable of, in the floating space 23, moving toward or away from the first contact point group 4, and is also capable of, in the floating space 23, moving toward or away from the second contact point group 5. The two sides of the opening 24 are disposed with a first limit part 25 protruding therefrom. When the conducting board 3 moves toward the first contact point group 4, the two limit parts 25 can be used for limiting and stopping movement to prevent the conducting board 3 from disengaging from the floating space 23. The contact portion between the first limit part 25 and the conducting board 3 can be tilted. The second inclination surface 22 is disposed at the side of the floating space away from the opening 24.

The conducting boards 3 are disposed in between the first contact point groups 4 and the second contact point groups 5, and can be used to conduct the first contact point groups 4 and the second contact point groups 5. Each of the conducting boards 3 has an insulated main body 31 and a plurality of conducting pins 32. The insulated main body 31 can be made of plastic, or other insulating materials, however, the structure and the material of the insulated main body 31 are not limited thereto. In the present embodiment, the insulated main body 31 is, corresponding to the first contact point groups 4 and the second contact point groups 5, formed into a long shape. The slope of the insulated main body 31 corresponds to the slopes of the first contact point groups 4 and the second contact point groups 5.

In the present embodiment, a plurality of conducting pillars 314 are disposed on the insulated main body 31 of each of the conducting boards 3, and the second main body 2 is disposed with conducting holes 26 corresponding to the conducting pillars 314. The conducting pillars 314 cooperatively slide in the conducting holes 26, which allows the conducting board 3 to be accurately assembled on the second main body 2, so as to limit the conducting board 3 to moving upward and downward (i.e., float), but not to the left or right. That is to say, the conducting board 3 can only move toward or away from the first contact point groups 4 and the second contact point groups 5.

The conducting pins 32 are disposed on the insulated main body 31 in a floating manner, and the conducting pins 32 are made of metal with good conductivity or alloy. The materials for the conducting pins 32 can be chosen from materials with high elastic coefficients, which allow the conducting pins 32 to have greater flexibility. The shape, amount and arrangement of the conducting pins 3 are not limited in the present disclosure, and can be adjusted in accordance with different practical demands. The conducting pins 32 are exposed from the two sides of the insulated main body 31, and the conducting pins 32 corresponding to the first contact point 41 and the second contact point 51, so that the conducting board 3 can conduct the first contact point 41 and the second contact point 51, which further allows for the conduction between the first contact point groups 4 and the second contact point groups 5.

Each of the conducting pins 32 has a first contact portion 321 and a second contact portion 322, and the first contact portion 321 and the second contact portion 322 are formed at the two ends of the conducting pin 32. The outer edge of the first contact portion 321 is in an arc shape; however, it can also be in a spherical shape. The outer edge of the second contact portion 322 is in an arc shape; however it can also be in a spherical shape. The second contact portion 322 can be bent into an arc-shaped plate body, making the second contact portion 322 an elastic arm. The inner side of the second contact portion 322 is hollow, which allows the second contact portion 322 to have better flexibility. The first contact portion 321 and the second contact portion 322 are respectively exposed from the two sides of the insulated main body 31. The first contact portions 321 and the second contact portions 322 of the conducting pin 32 correspond with each other, the second contact portions 322 of the conducting pin 32 correspond to the second contact points 51, and the second contact portions 322 of the conducting pin 32 are correspondingly in contact with the second contact points 51, i.e., the second contact portions 322 of the conducting pin 32 and the second contact points 51 are maintained in a state of connection.

In the present embodiment, a plurality of pin accommodation holes 311 are disposed on the insulated main body 31 of each of the conducting boards 3, and the conducting pins 32 are respectively disposed in the pin accommodation holes 311 in a floating manner. The first contact portion 321 and the second contact portion 322 connect with the two opposite sides of the pin body 323, and the pin body 323 is disposed in the corresponding pin accommodation hole 311 in a floating manner, so that the conducting pins 32 are disposed on the insulated main body 31 in a floating manner. A second limit part 312 and a third limit part 313 are disposed at the two ends of the pin accommodation hole 311. When the conducting pins 32 move (float), the second limit part 312 and the third limit part 313 can be used by the pin body 323 for limiting and stopping movement to prevent the conducting pins 32 from disengaging from the pin accommodation hole 311.

The conducting board 3 can be in contact with the first contact point groups 4 and the second contact point groups 5, which means when the first main body 1 and the second main body 2 are engaged with one another, the first contact portions 321 of the conducting pins 32 are correspondingly in contact with the first contact points 41, and by conducting the first contact points 41 and the second contact points 51 over the conducting pins 32, the plurality of first contact point groups 4 electrically connect with the plurality of second contact point groups 5.

The Second Embodiment

Figure 13:
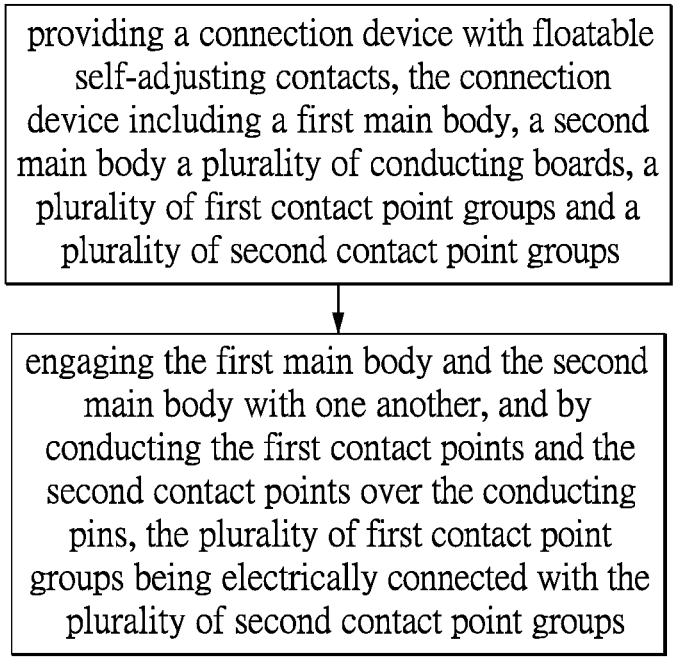
FIG. 13 is a flowchart of the connection method according to the present disclosure.

Reference is next made to FIG. 13, in which the connection method with floatable self-adjusting contacts of the present disclosure includes the following steps.

Firstly, providing a connection device with floatable self-adjusting contacts including a first main body 1, a second main body 2, a plurality of conducting boards 3, a plurality of first contact point groups 4 and a plurality of second contact point groups 5. The plurality of conducting boards 3 are floatably disposed on the second main body 2, each of the plurality of conducting boards 3 has an insulated main body 31, and a plurality of conducting pins 32 are disposed on the insulated main body 31 in a floating manner. Each of the plurality of conducting pins 32 has a first contact portion 321 and a second contact portion 322, and the first contact portion 321 and second contact portion 322 are formed at two ends of the conducting pin 32. The outer edge of the first contact portion 321 is an arced surface, the outer edge of the second contact portion 322 is an arced surface, and the first and second contact portions 321, 322 are respectively exposed from the two surfaces of the insulated main body 31. The plurality of first contact point groups 4 are disposed on the first main body 1 and are tilted, the plurality of first contact point groups 5 have a plurality of first contact points 41 exposed from the outer edge of the first contact point groups 4, the plurality of second contact point groups 5 are disposed on the second main body 2 and are tilted, and the plurality of second contact point groups 5 has a plurality of second contact points 51 exposed from the inner edge of the second contact point groups 5. The second contact portions 51 of the conducting pins 32 are correspondingly in contact with the second contact points 51. Since the implementations and the structures of the first main body 1, the second main body 2, the conducting board 3, the first contact point group 4 and the second contact point group 5 are identical to those in the previous embodiment, details thereof will be omitted for the sake of brevity.

Secondly, engaging the first main body 1 and the second main body 2 with one another, so that the first contact portions 321 of the conducting pins 32 is correspondingly in contact with the first contact points 41. By conducting the first contact points 41 and the second contact points 51 over the conducting pins 32, the plurality of first contact point groups 4 are electrically connected with the plurality of second contact point groups 5. The outer edge of the first contact portion 321 is an arced surface, and the outer edge of the second contact portion 321 is also an arced surface.

That is, the connection manner of the present disclosure is by 3D mechanical connection. The inclination surfaces of the present disclosure can generate more contact points than straight surfaces, thereby increasing the density of contact point, and the contact force can be guaranteed.

The outer edges of the first contact portion 321 and the second contact portion 322 of the conducting pins 32 are arced surfaces, which exerts a greater normal force to the first contact points 41 and the second contact points 51. The first contact and second contact portions 321, 322 of the conducting pin 32 provide a contact normal force perpendicular to the first and second contact points 41, 51 to achieve an optimal electrical contact effect. Moreover, the conducting board 3 is disposed on the second main body 2 in a floating manner and the conducting pin 32 is also disposed on the insulated main body 31 in a floating manner, so that the conducting pin 32 has a floating design. The conducting pin 32 in the conducting board 3 can respectively, through self-adjustment, reach an optimal downward pressure for each contact point, so as to achieve an optimal electrical contact. The present disclosure, by the floating state of the conducting pin 32, achieves an optical manner of connection, thereby overcoming the process dimension tolerance and the problems of uneven contact height due to the deformation of the contact surface of the main body.

The first main body 1 and the second main body 2 of the present disclosure can rotate relative to each other, so that the conducting pins 32 can rub and contact with the first contact points 41, thus removing the oxide layers of the first contact points 41. That is, the conducting pins 32 can contact with the first contact points 41 more effectively.

The connection device of the present disclosure can be applied to medical devices, electronic devices, electro-mechanical devices or other devices to provide the devices with more contact points. That is, the number of connection devices and the spaces occupied can be decreased for a more convenient operational process.

The description illustrated supra set forth simply the preferred embodiments of the present disclosure; however, the characteristics of the present disclosure are by no means restricted thereto. All changes, alterations, or modifications conveniently considered by those skilled in the art are deemed to be encompassed within the scope of the present disclosure delineated by the following claims.

What is claimed is:

1. A connection device with floatable self-adjusting contacts, comprising:

a first main body;

a second main body, wherein a plurality of floating spaces are compartmentally and circularly formed thereon, and a plurality of openings are respectively formed at one side of the floating spaces, and each of two sides of each of the openings is disposed with a first limit part protruding therefrom;

a plurality of conducting boards floatably disposed on the second main body and in the floating spaces, each of the plurality of conducting boards having an insulated main body, and a plurality of conducting pins being disposed on the insulated main body in a floating manner, each of the plurality of conducting pins having a first contact portion and a second contact portion, the first and second contact portions being formed at two ends of the conducting pin, the outer edge of the first contact portion being an arced surface, the outer edge of the second contact portion being an arced surface, and the first and second contact portions respectively being exposed from two surfaces of the insulated main body;

a plurality of first contact point groups disposed on the first main body and being tilted, the plurality of first contact point groups having a plurality of first contact points exposed from the outer edge of the first contact point groups; and a plurality of second contact point groups disposed on the second main body and being tilted, the plurality of second contact point groups having a plurality of second contact points exposed from the inner edge of the second contact point groups, the second contact portions of the conducting pins being correspondingly in contact with the second contact points;

wherein when the first main body and the second main body are engaged with one another, the first contact portions of the conducting pins are correspondingly in contact with the first contact points, and by conducting the first contact points and the second contact points over the conducting pins, the plurality of first contact point groups electrically connect with the plurality of second contact point groups; and wherein each of the conducting boards is capable of moving toward or away from the first contact point groups, wherein when the conducting board moves toward the first contact point groups, the two first limit parts limit and stop the conducting board, and the first contact portions of the conducting pins contact with the first contact point groups through the openings.

2. The connection device with floatable self-adjusting contacts according to claim 1, wherein the second contact portion is bent to be an arc-shaped plate body, and the inner side of the second contact portion is hollow, making the second contact portion an elastic arm.

3. The connection device with floatable self-adjusting contacts according to claim 1, wherein a plurality of pin accommodation holes are disposed on the insulated main body of each of the conducting boards, the conducting pins are respectively floatably disposed in the pin accommodation holes, each of the conducting pins has a pin body, the first contact portion and the second contact portion connect with the two opposite sides of the pin body, the pin body is disposed in the corresponding pin accommodation hole in a floating manner, a second limit part and a third limit part are disposed at the two ends of the pin accommodation hole, wherein when the conducting pins move, the pin body is capable of limiting and stopping movement through the second and third limit parts.

4. The connection device with floatable self-adjusting contacts according to claim 1, wherein a plurality of conducting pillars are disposed on the insulated main body of each of the conducting boards, the second main body is disposed with conducting holes corresponding to the conducting pillars, and the conducting pillars movably slide to cooperate with the conducting holes to guide the conducting boards.

5. The connection device with floatable self-adjusting contacts according to claim 1, wherein a plurality of first inclination surfaces are disposed on the first main body, the plurality of first contact point groups are disposed on the first inclination surfaces, an accommodation slot is disposed in the second main body, a plurality of second inclination surfaces are disposed in the accommodation slot, and the second contact point groups are disposed on the inclination surfaces, wherein the slope of the first contact point group is defined as $\theta 1$ and $\theta 1$ is between 0° and 90°, and the slope of the second contact point group is defined as $\theta 2$ and $\theta 2$ is between 0° and 90°.

6. A connection method with floatable self-adjusting contacts, comprising:

providing a connection device with floatable self-adjusting contacts including a first main body, a second main body, a plurality of conducting boards, a plurality of first contact point groups and a plurality of second contact point groups, the plurality of conducting boards being floatably disposed on the second main body, each of the plurality of conducting boards having an insulated main body, and a plurality of conducting pins being disposed on the insulated main body in a floating manner, each of the plurality of conducting pins having a first contact portion and a second contact portion, the first and second contact portions being formed at two ends of the conducting pin, the outer edge of the first contact portion being an arced surface, the outer edge of the second contact portion being an arced surface, and the first and second contact portions respectively being exposed from two surfaces of the insulated main body, the plurality of first contact point groups being disposed on the first main body and being tilted, the plurality of first contact point groups having a plurality of first contact points exposed from the outer edge of the first contact point groups, the plurality of second contact point groups being disposed on the second main body and being tilted, the plurality of second contact point groups having a plurality of second contact points exposed from the inner edge of the second contact point groups, the second contact portions of the conducting pins being correspondingly in contact with the second contact points, wherein the second main body has a plurality of floating spaces formed compartmentally and circularly thereon, a plurality of openings are respectively formed at one side of the floating spaces, each of two sides of each of the opening is disposed with a first limit part protruding therefrom, the conducting boards are floatably disposed in the floating spaces respectively, the conducting boards are capable of moving toward or away from the first contact point groups respectively; and engaging the first main body and the second main body with one another, the first contact portions of the conducting pins being correspondingly in contact with the first contact points, and by conducting the first contact points and the second contact points over the conducting pins, the plurality of first contact point groups being electrically connected with the plurality of second contact point groups;

wherein when one of the conducting boards moves toward the first contact point groups, the two limit parts limit and stop the conducting board, and the first contact portions of the conducting pins contact with the first contact point groups through the openings.

7. The connection method with floatable self-adjusting contacts according to claim 6, wherein the second contact portion is bent to be an arc-shaped plate body, and the inner side of the second contact portion is hollow, making the second contact portion an elastic arm.

8. The connection method with floatable self-adjusting contacts according to claim 6, wherein a plurality of pin accommodation holes are disposed on the insulated main body of each of the conducting boards, the conducting pins are respectively floatably disposed in the pin accommodation holes, each of the conducting pins has a pin body, the first contact portion and the second contact portion connect with the two opposite sides of the pin body, the pin body is disposed in the corresponding pin accommodation hole in a floating manner, a second limit part and a third limit part are disposed at the two ends of the pin accommodation hole, wherein when the conducting pins move, the pin body is capable of limiting and stopping movement through the second and third limit parts.

9. The connection method with floatable self-adjusting contacts according to claim 6, wherein a plurality of conducting pillars are disposed on the insulated main body of each of the conducting boards, the second main body is disposed with conducting holes corresponding to the conducting pillars, and the conducting pillars movably slide to cooperate with the conducting holes to guide the conducting boards.

10. The connection method with floatable self-adjusting contacts according to claim 6, wherein a plurality of first inclination surfaces are disposed on the first main body, the plurality of first contact point groups are disposed on the first inclination surfaces, an accommodation slot is disposed in the second main body, a plurality of second inclination surfaces are disposed in the accommodation slot, and the second contact point groups are disposed on the inclination surfaces, wherein the slope of the first contact point group is defined as θ1 and θ1 is between 0° and 90°, and the slope of the second contact point group is defined as θ2 and θ2 is between 0° and 90°.

11. A connection device with floatable self-adjusting contacts, comprising:

a first main body;

a second main body;

a plurality of conducting boards floatably disposed on the second main body, each of the plurality of conducting boards having an insulated main body, and a plurality of conducting pins being disposed on the insulated main body in a floating manner, each of the plurality of conducting pins having a first contact portion and a second contact portion, the first and second contact portions being formed at two ends of the conducting pin, the outer edge of the first contact portion being an arced surface, the outer edge of the second contact portion being an arced surface, and the first and second contact portions respectively being exposed from two surfaces of the insulated main body;

a plurality of conducting pillars, disposed on the insulated main body of each of the conducting boards, wherein the second main body is formed with a plurality of conducting holes corresponding to the conducting pillars, and the conducting pillars movably slide to cooperate with the conducting holes to guide the conducting boards;

a plurality of first contact point groups disposed on the first main body and being tilted, the plurality of first contact point groups having a plurality of first contact points exposed from the outer edge of the first contact point groups; and a plurality of second contact point groups disposed on the second main body and being tilted, the plurality of second contact point groups having a plurality of second contact points exposed from the inner edge of the second contact point groups, the second contact portions of the conducting pins being correspondingly in contact with the second contact points;

wherein when the first main body and the second main body are engaged with one another, the first contact portions of the conducting pins are correspondingly in contact with the first contact points, and by conducting the first contact points and the second contact points over the conducting pins, the plurality of first contact point groups electrically connect with the plurality of second contact point groups.

* * * * *